US006401472B2

(12) United States Patent
Pollrich et al.

(10) Patent No.: US 6,401,472 B2
(45) Date of Patent: Jun. 11, 2002

(54) REFRIGERANT COMPRESSOR APPARATUS

(75) Inventors: Volker Pollrich, Schkeuditz; Guenter Dittrich, Greppin; Helmut Barowsky, Bergfelde; Wolfgang Sandkoetter, Herrenberg, all of (DE)

(73) Assignee: Bitzer Kuehlmaschinenbau GmbH, Sindelfingen (DE)

( * ) Notice: Subject to any disclaimer, the term of this patent is extended or adjusted under 35 U.S.C. 154(b) by 0 days.

(21) Appl. No.: 09/747,356

(22) Filed: Dec. 21, 2000

Related U.S. Application Data

(63) Continuation of application No. PCT/EP00/03606, filed on Apr. 20, 2000.

(30) Foreign Application Priority Data

Apr. 22, 1999 (DE) ..... 199 18 161

(51) Int. Cl.[7] ..... F25B 1/00; F25B 49/00; F04B 17/00; F04B 49/00

(52) U.S. Cl. ..... 62/228.4; 62/196.2; 417/415; 417/213

(58) Field of Search ..... 62/505, 228.4, 62/196.2, 228.5; 417/273, 415, 366, 213

(56) References Cited

U.S. PATENT DOCUMENTS 1,716,049 A 4/1929 Greve
2,178,662 A * 11/1939 Hanson
2,427,638 A 9/1947 Vilter et al.
2,454,600 A 11/1948 Fischer
2,572,711 A 10/1951 Fischer
3,663,127 A * 5/1972 Cheers ..... 417/372
4,743,176 A * 5/1988 Fry ..... 417/368
5,255,529 A * 10/1993 Powell et al. ..... 62/180
5,540,061 A * 7/1996 Gommoi et al. ..... 62/277
6,041,609 A * 3/2000 Hornsleth et al. ..... 62/259.2
6,131,406 A 10/2000 Barowsky et al.

FOREIGN PATENT DOCUMENTS

DE 42 12 162 10/1993
DE 197 26 943 1/1999

* cited by examiner

*Primary Examiner*—William C. Doerrler
(74) *Attorney, Agent, or Firm*—Barry R. Lipsitz

(57) ABSTRACT

In order to improve a refrigerant compressor apparatus comprising a drive motor, a compressor driven by the drive motor and having several cylinders arranged in a V shape and a compressor shaft bearing eccentrics for driving pistons operating in the respective cylinders in such a manner that as smooth a running as possible can be achieved at any desired V angle it is suggested that the cylinders be arranged at a V angle of less than 90°, that the compressor shaft be mounted with only two bearing sections thereof in corresponding compressor shaft bearings, that the eccentrics be arranged between the bearing sections and that a separate eccentric be provided for each piston and be arranged at a distance from the other, individual eccentrics for the respectively other pistons.

31 Claims, 10 Drawing Sheets

Figure 1:
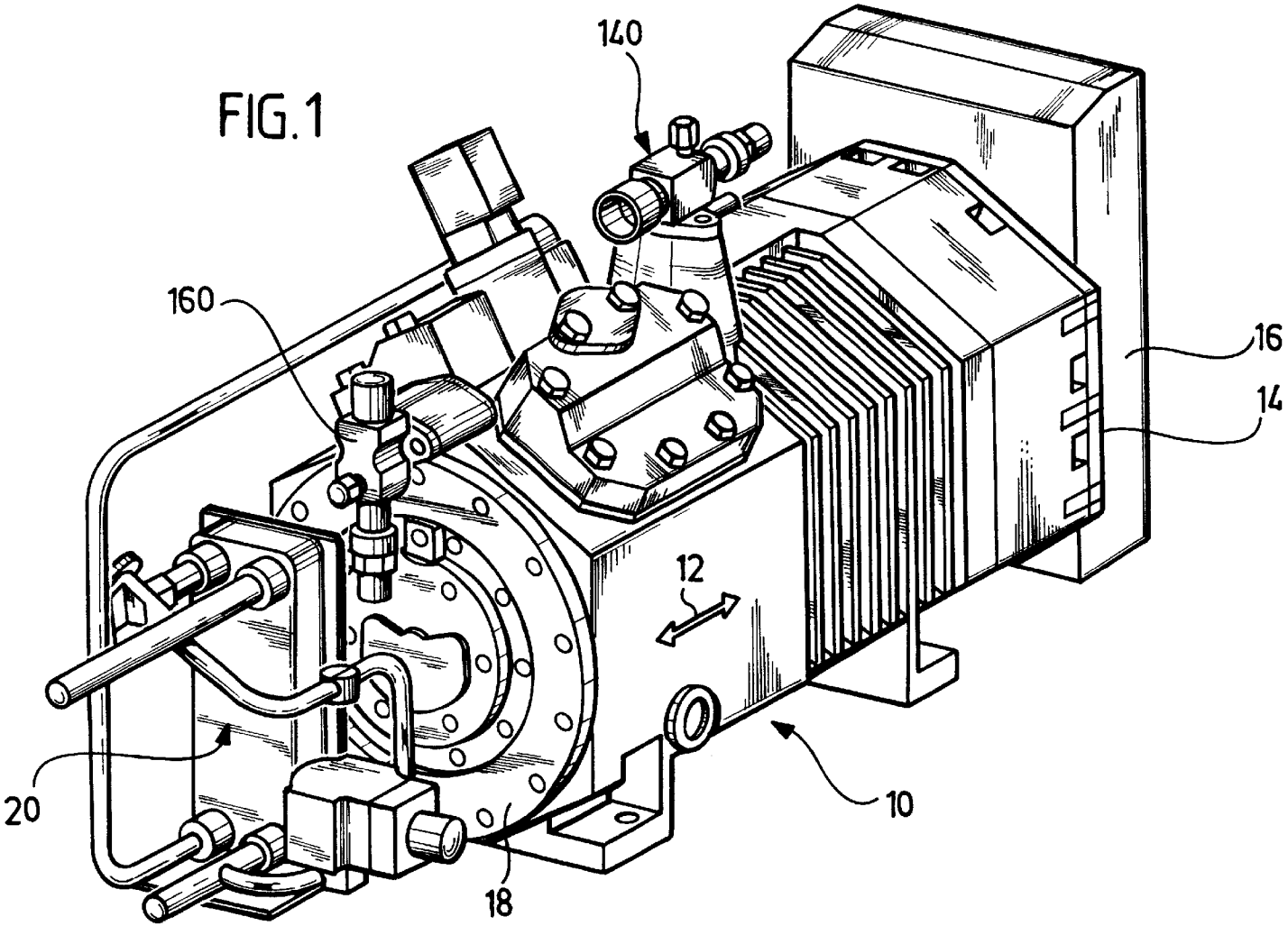

206
204
202a
176
174
178
202b
164
166
162
172
140
190
192
170
20
168
16
194
40
160
188
180
200
186
182
184

REFRIGERANT COMPRESSOR APPARATUS

This application is a continuation of international application number PCT/EP00/0306 filed on Apr. 20, 2000.

The invention relates to a refrigerant compressor apparatus comprising a drive motor, a compressor driven by the drive motor and having several cylinders arranged in a V shape and a compressor shaft bearing eccentrics for driving pistons operating in the respective cylinders.

Refrigerant compressor apparatuses of this type are known from the state of the art. With these the eccentrics are normally designed such that one eccentric serves to drive several cylinders in order to achieve a solution which is, on the one hand, of a compact construction and inexpensive.

Refrigerant compressor apparatuses of this type do, however, have the disadvantage of an uneven running when there is any deviation from an ideal V angle of 360° divided by the number of cylinders.

The object underlying the invention is to improve a refrigerant compressor apparatus of the generic type in such a manner that as smooth a running as possible can be achieved at any desired V angle.

This object is accomplished in accordance with the invention, in a refrigerant compressor apparatus of the type described at the outset, in that the cylinders are arranged at a V angle of less than 90°, that the compressor shaft is mounted with only two bearing sections thereof in corresponding compressor shaft bearings, that the eccentrics are arranged between the bearing sections and that a separate eccentric is provided for each piston and this is arranged at a distance from the other individual eccentrics for the respectively other pistons.

The advantage of the inventive solution is to be seen in the fact that as a result of the independent arrangement of the eccentrics their rotary position relative to one another can be adjusted as required and that, as a result, a very smooth running can be achieved irrespective of the desired V angle due to free selectability of the angular position of the individual eccentrics relative to one another.

At the same time, the advantage of the simple type of construction is, however, still retained, in particular, the simple mounting with only two bearing sections of the compressor shaft.

It is particularly favorable, in order to be able to mount individual, undivided piston rods on the eccentrics, when the individual eccentrics are separated from one another by intermediate elements which have in the direction of an axis of rotation a length which corresponds at least to a width of a piston rod.

As a result of such intermediate elements, the sliding on of the undivided piston rods can be made substantially easier since a reorientation of the piston rod for sliding the same onto the next following intermediate element is possible after each eccentric.

In this respect, it is particularly favorable when the compressor shaft has between two consecutive eccentrics intermediate elements with a cross-sectional shape which extends in a radial direction in relation to the axis of rotation at the most as far as the closest one of two casing surfaces, of which one is the casing surface of the one eccentric and the other the casing surface of the other eccentric of the two consecutive eccentrics.

In order to bring about an optimum lubrication it is preferably provided for the compressor shaft to have a lubricant channel coaxial to the axis of rotation, wherein transverse channels for the lubrication of running surfaces of the eccentrics preferably branch off the lubricant channel in the area of each eccentric.

The lubricant bore is likewise preferably designed such that transverse channels branch off it for the lubrication of the bearing sections thereof.

With respect to the V angle provided between the cylinders it has merely been assumed thus far that this is smaller than 90°.

It is particularly advantageous when the cylinders arranged in a V shape form with one another a V angle of less than 70°. A particularly narrow type of construction can be achieved when the cylinders arranged in a V shape form with one another a V angle of approximately 60° or less.

With all these solutions, with which the V angle is smaller than 70°, it is provided, in particular, for each of the eccentrics to be arranged in relation to the other eccentrics so as to be turned through an angle with respect to an axis of rotation of the compressor shaft.

A particularly favorable solution provides for the eccentrics to form pairs which are arranged so as to follow one another in the direction of the axis of rotation of the compressor shaft, wherein the eccentrics forming one pair are arranged so as to be turned relative to one another through an angle of 360° divided by the number of cylinders plus the V angles and, in particular, each of the eccentrics of one pair is associated with one of two cylinders arranged in the V angle in relation to one another.

This solution has the great advantage that it brings about a compact construction since respective eccentrics following one another are associated with respective cylinders arranged in a V shape in relation to one another and are in a position to drive these with as smooth a running as possible.

In this respect, it is particularly favorable when the first eccentrics of each of the pairs and the second eccentrics of each of the pairs are arranged so as to be respectively turned through 180° in relation to one another so that they operate in opposite directions to one another.

With all these solutions it is preferably provided for two respective eccentrics following one another to be associated with two respective cylinders arranged in a V shape in relation to one another in the case of all the eccentrics of the compressor shaft so that eccentrics arranged to follow one another are associated alternatingly with cylinders arranged on different sides.

One particularly advantageous solution provides for the compressor to comprise at least four cylinders and for the compressor shaft to comprise at least four separate eccentrics arranged at a distance from one another.

With respect to the use of individual cylinders no further details have so far been given. One particularly favorable embodiment of an inventive refrigerant compressor apparatus provides for the compressor to have a low pressure stage comprising at least one cylinder and a high pressure stage comprising at least one cylinder.

The high pressure stage and the low pressure stage are preferably subdivided such that one row of the cylinders arranged in a V shape forms the low pressure stage and the other row of the cylinders the high pressure stage.

With respect to the cylinder volumes of the low pressure stage and the high pressure stage no details whatsoever have so far been given. The cylinder volumes could, for example, be the same and it would be possible to adjust the capacities of high pressure stage and low pressure stage on account of the different eccentricity.

It has, however, proven to be particularly favorable when the eccentricity of the eccentrics with respect to the axis of rotation is the same and when the sum of the cylinder volumes of the low pressure stage is greater than the sum of the cylinder volumes of the cylinders of the high pressure stage so that an adjustment of high pressure stage and low pressure stage is brought about via the sum of the cylinder volumes.

One particularly favorable embodiment of the inventive solution provides for the low pressure stage to be reduced in capacity, in particular, to be switched off with respect to its compression effect. This is especially advantageous when a regulation of the capacity of the inventive refrigerant compressor apparatus is desired and, in particular, with a low cooling capacity the low pressure stage which is not, as such, required can be reduced in its capacity or switched off with respect to its compression effect in order to reduce the power input of the compressor.

Such a switching off of the low pressure stage may be realized in the most varied of ways. For example, it would be conceivable to have the low pressure stage operating free from compression, i.e. such that no compression at all of the refrigerant takes place.

Another possibility would be to open a bypass line to the low pressure stage.

A particularly favorable solution provides for a capacity regulation valve to be arranged on the suction side of the low pressure stage and for a valve which opens when a capacity regulation valve is active to be arranged between a low pressure connection of the compressor and a suction side of the high pressure stage.

A valve of this type may, for example, be actively controlled.

A particularly simple solution does, however, provide for the valve between the low pressure connection of the compressor and the suction side of the high pressure stage to be a check valve which opens automatically when a capacity regulation valve is active, dependent on the resulting difference in pressure, so that a targeted control of this valve between the low pressure side of the compressor and the suction side of the high pressure stage is not necessary and can be omitted.

In addition, a check valve has the advantage that this opens automatically when the pressure on the suction side of the high pressure stage is equal to or lower than the pressure at the low pressure connection and so no additional measures whatsoever are required for the exact control of this valve in the case of such pressure ratios.

With respect to the cooling of the drive motor, no further details have been given in conjunction with the preceding explanations concerning the individual embodiments.

It would, for example, be conceivable to cool the drive motor by means of the surrounding air or by means of the suction gas.

A particularly advantageous embodiment provides for the drive motor of the compressor to have the refrigerant flowing from the low pressure stage to the high pressure stage flowing through it and to be cooled as a result of this.

In this respect it is possible, in the case of any switching off of the low pressure stage, not to guide the refrigerant flowing directly from the low pressure connection to the suction side of the high pressure connection through the drive motor since, in this case, it can be assumed that the power requirements of the drive motor are, in any case, so low that the waste heat resulting in the drive motor can be discharged by means of the surrounding atmosphere or due to the coupling of the interior via the refrigerant not automatically guided through the interior.

A particularly favorable solution which in any case ensures an adequate cooling of the drive motor provides for the drive motor of the compressor to have the refrigerant entering the high pressure stage flowing through it, i.e. for the refrigerant which enters the high pressure stage to essentially flow through the drive motor, as well, and thus always ensure an adequate cooling of the drive motor.

In order to be able to provide a three-phase motor as drive motor it is preferably provided for a converter to be arranged on the drive motor, wherein the converter is preferably arranged on the drive motor such that its power components are thermally coupled to a housing of the drive motor.

Such a coupling to the housing of the drive motor may be achieved in a simple manner in that the power components are either coupled to an intermediate element or are arranged directly on the housing of the drive motor.

In order to ensure an adequate heat discharge it is provided, in particular, in the case of a drive motor cooled by the refrigerant for a housing part thermally coupled to the power components of the converter to be in thermal contact with the refrigerant, preferably with the stream of refrigerant flowing through the drive motor. As a result, an effective coupling of the amount of heat resulting in the power components of the converter to the refrigerant and thus an efficient discharge of the same is ensured.

A particularly advantageous arrangement of the converter, in particular, with a view to a compact and narrow type of construction of the inventive refrigerant compressor apparatus provides for the converter to be arranged on a side of the housing of the drive motor located opposite the compressor.

A refrigerant compressor apparatus operating according to the invention may be operated particularly advantageously, especially with a view to the energy consumption, when the drive motor is speed controlled, wherein a speed control of the drive motor preferably takes place with consideration of the cooling capacity required.

For example, a control is provided for the speed control of the drive motor which controls the speed of the drive motor in accordance with the required cooling capacity.

The inventive control which controls the speed of the drive motor may be used particularly advantageously for regulating the temperature of a medium to be cooled with the inventive refrigerant compressor apparatus, wherein the control detects the temperature of the medium to be cooled and controls the speed accordingly.

A particularly precise regulation of the temperature of the medium to be cooled is brought about when the control operates the drive motor free from any running interruptions and the entire temperature regulation is brought about exclusively via the speed and, where applicable, switching off of the low pressure stage.

Only in the case of a minimum cooling capacity of the inventive refrigerant compressor apparatus, which is less than 5% of the maximum cooling capacity, will a temporary interruption in the running of the drive motor be brought about during the regulation of the temperature of the medium to be cooled since, in this case, the heat input into the medium to be cooled is so slight that a precise regulation is also possible during a temporary interruption in the running of the drive motor.

It is, in addition, particularly expedient when the control controls the speed of the drive motor in accordance with ambient temperature.

Furthermore, an additional, advantageous development of the inventive refrigerant compressor apparatus provides for a control to be provided which switches off the low pressure stage when the cooling capacity falls below a predeterminable capacity. As a result, the possibility is created, in particular, in a simple manner of reducing the power to be supplied by the drive motor for the operation of the compressor, in addition, in the cases where such a slight cooling capacity is required that it can be supplied solely by the high pressure stage of the compressor.

Preferably, this likewise takes place as a function of the ambient temperature. A particularly favorable solution provides for the control for,the speed of the drive motor and for the switching off of the low pressure stage to be the same.

No further details have been given in conjunction with the preceding description of the inventive refrigerant compressor apparatus as to how this is intended to be operated. One advantageous embodiment provides for a liquid supercooler to be associated with the refrigerant compressor apparatus.

Those skilled in the art will appreciate that the term supercooler may be used interchangeably with the terms subcooler, undercooler, and overcooler.

In order to keep the type of construction of the refrigerant compressor apparatus likewise as compact as possible, it is preferably provided for the liquid supercooler to be arranged on a side of the compressor located opposite the drive motor.

The liquid supercooler is preferably designed such that it vaporizes liquid refrigerant for the liquid supercooling and this vaporized refrigerant enters the refrigerant flowing to the high pressure stage.

In order to bring about an optimum cooling of the drive motor, it is preferably provided for the refrigerant vaporized by the liquid supercooler to flow through the drive motor on its way to the high pressure stage.

The vaporized refrigerant is preferably supplied to the medium pressure channel prior to flowing through the drive motor.

A solution which is particularly advantageous with respect to the adequate cooling of the drive motor provides for the liquid supercooler to be controllable in accordance with a temperature of the drive motor. The detection of the temperature of the drive motor is preferably brought about via a detection of the temperature of the housing of the drive motor.

A particularly favorable solution, in particular, for the efficient cooling of the converter provides for the liquid supercooler to be controllable in accordance with the temperature of the part of the housing of the drive motor bearing the converter.

In order, however, to avoid condensed water forming in the area of the drive motor, it is preferably provided for the liquid supercooler to be controlled such that it maintains a minimum temperature of the part of the housing bearing the converter, wherein the minimum temperature of the part of the housing bearing the converter is selected such that no condensation whatsoever of moisture from the ambient air can occur.

For example, it is provided for the control of the liquid supercooler to be brought about in such a manner that the part of the housing bearing the converter remains at a temperature of at least 10° centigrade, preferably at least 20° centigrade.

Furthermore, it is preferably provided for the liquid supercooler to be controlled such that the maximum temperature of the part of the housing bearing the converter does not exceed a predetermined temperature. This predetermined temperature is at approximately 60° centigrade, preferably approximately 50° centigrade.

Additional features and advantages of the invention are the subject matter of the following description as well as the drawings illustrating one embodiment.

Figure 2:
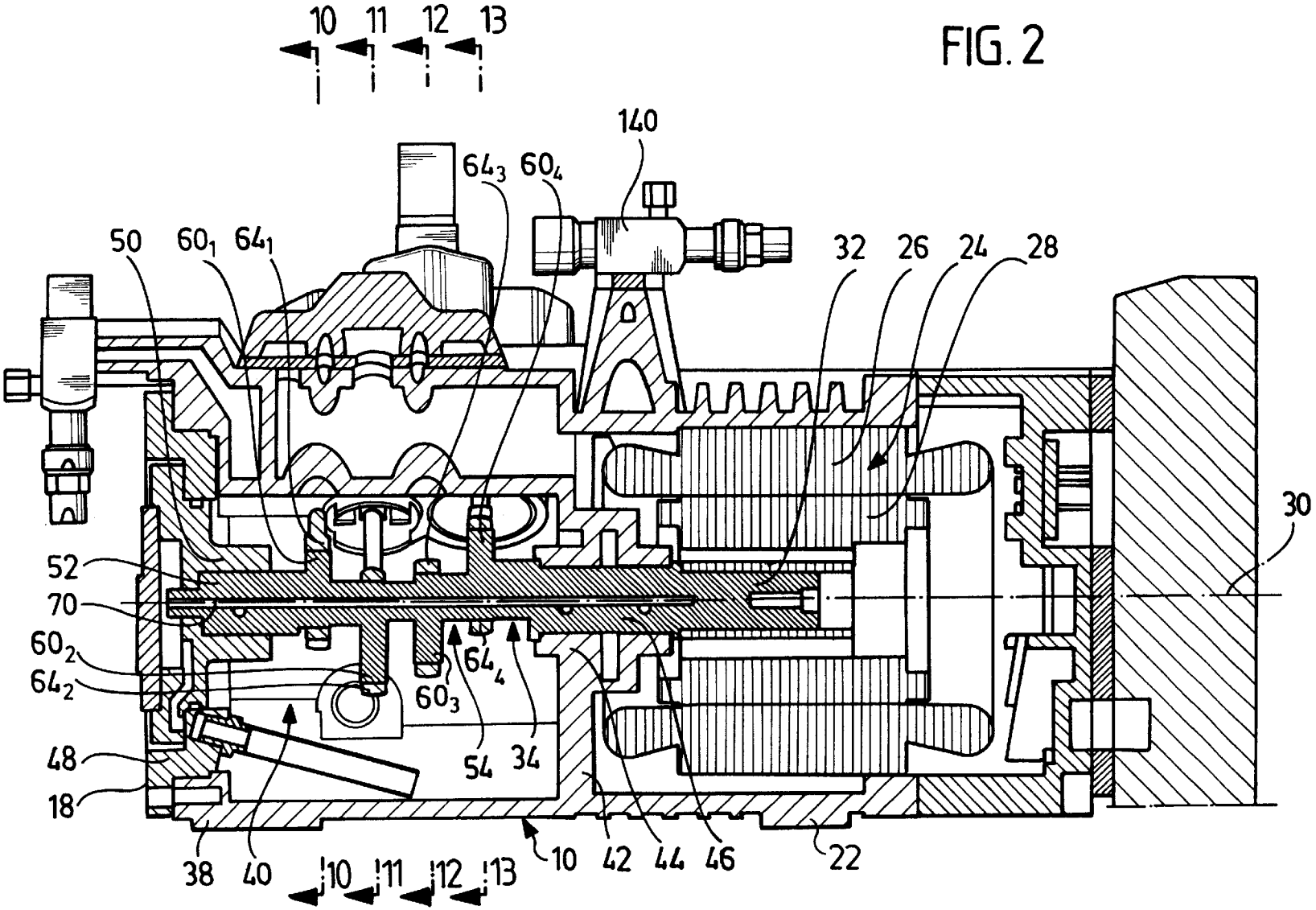
Figures 3, 4, 5, 6, 7, 8, 9:
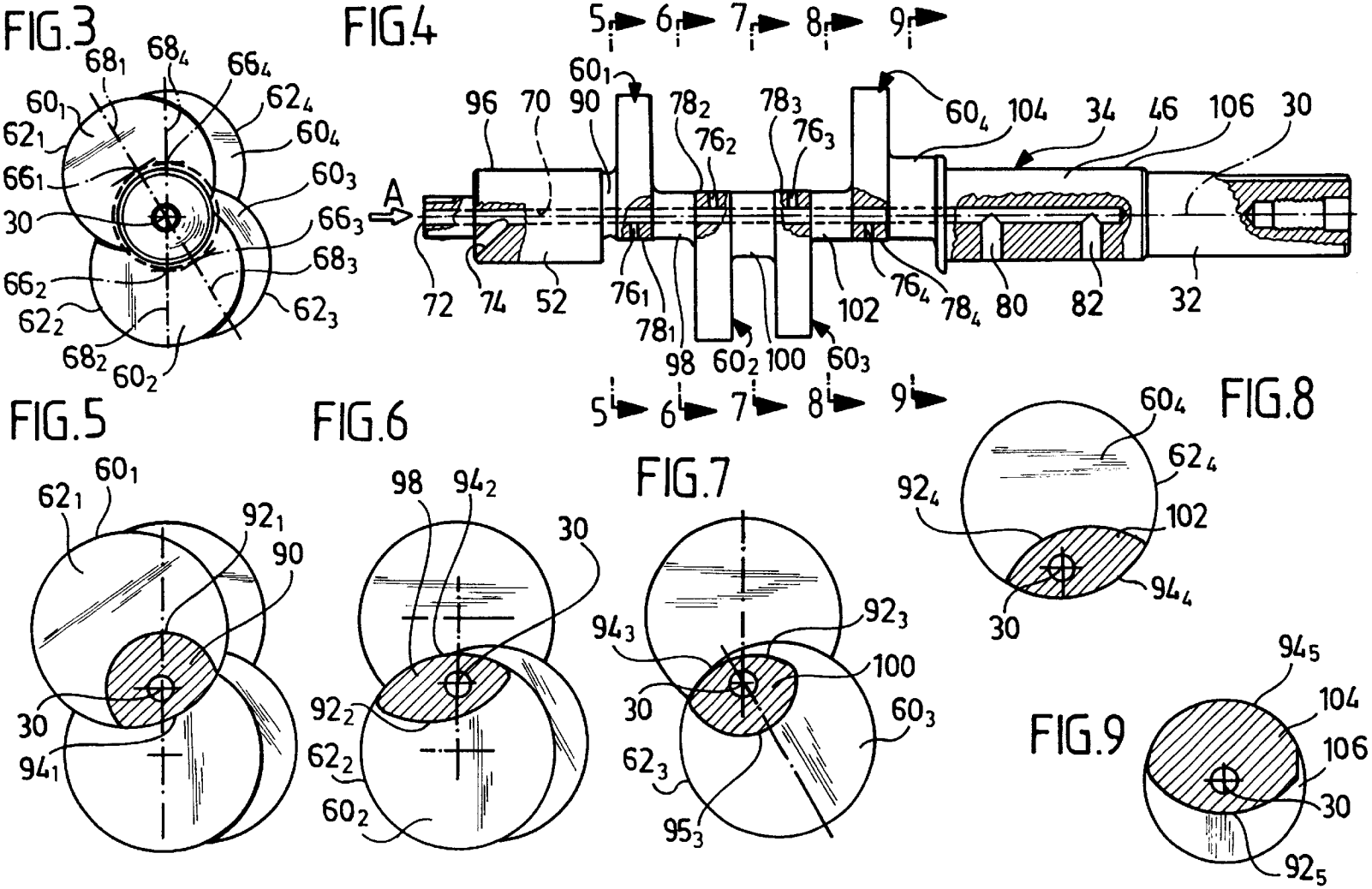
Figure 10:
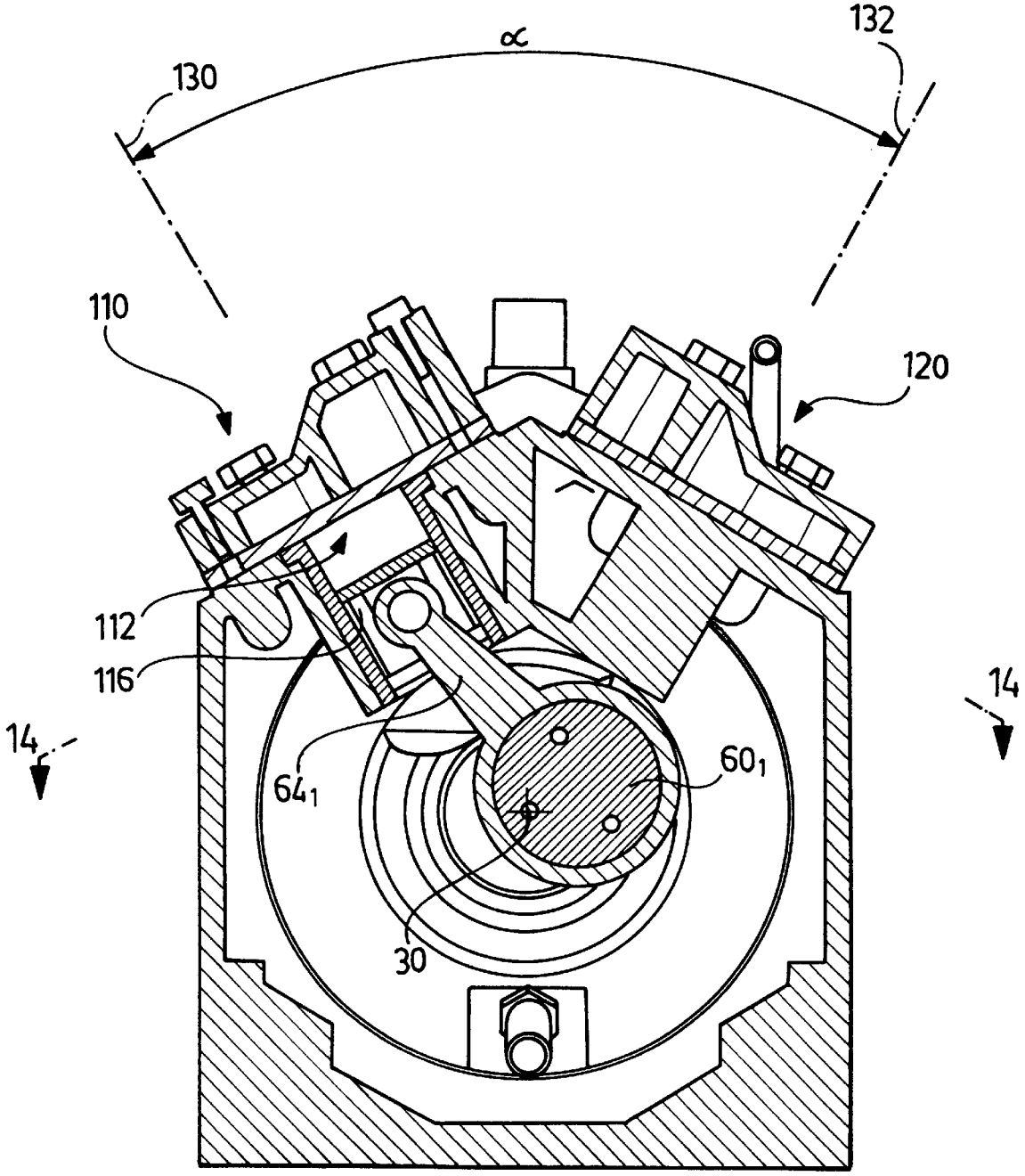
Figure 11:
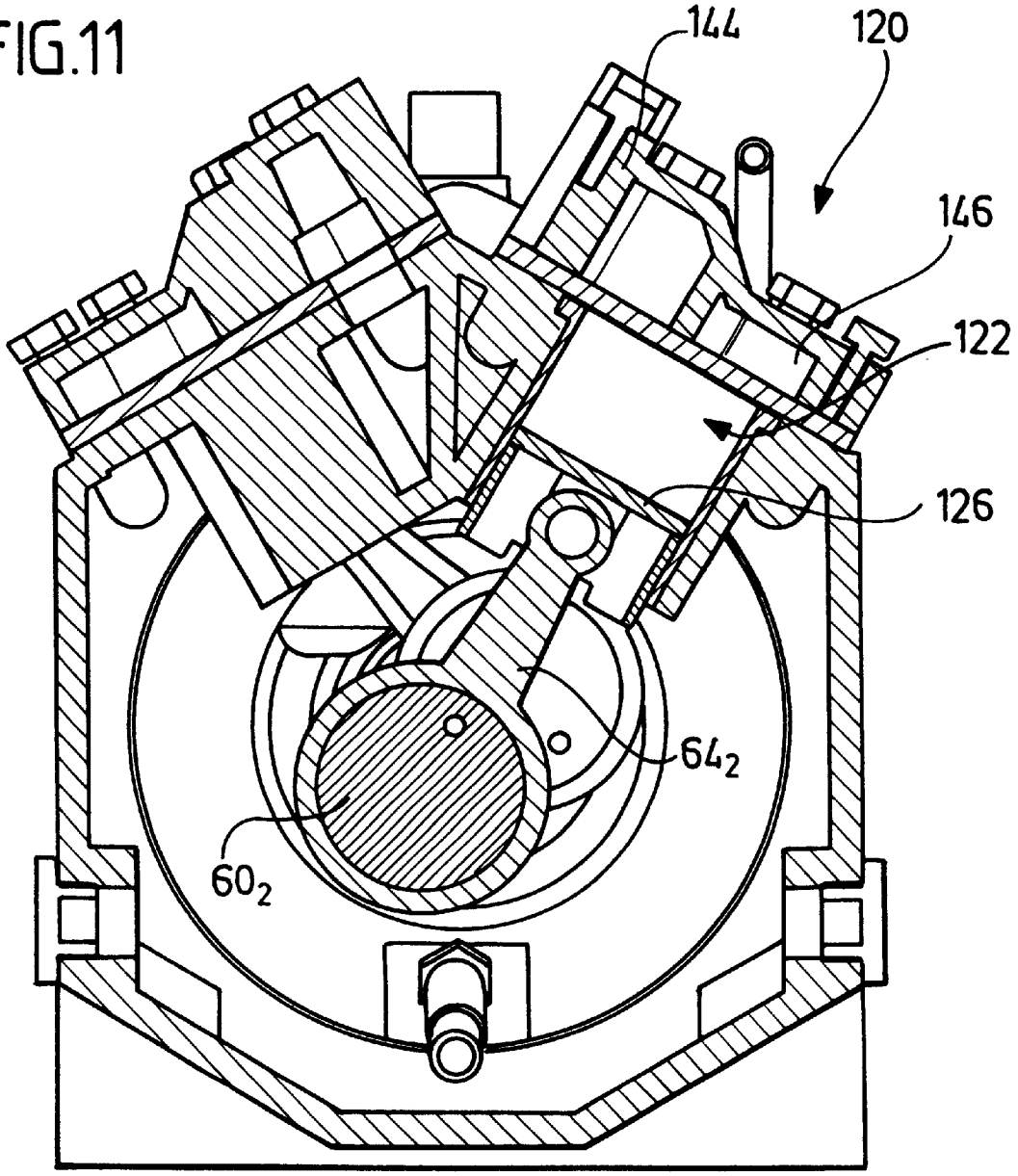
Figure 12:
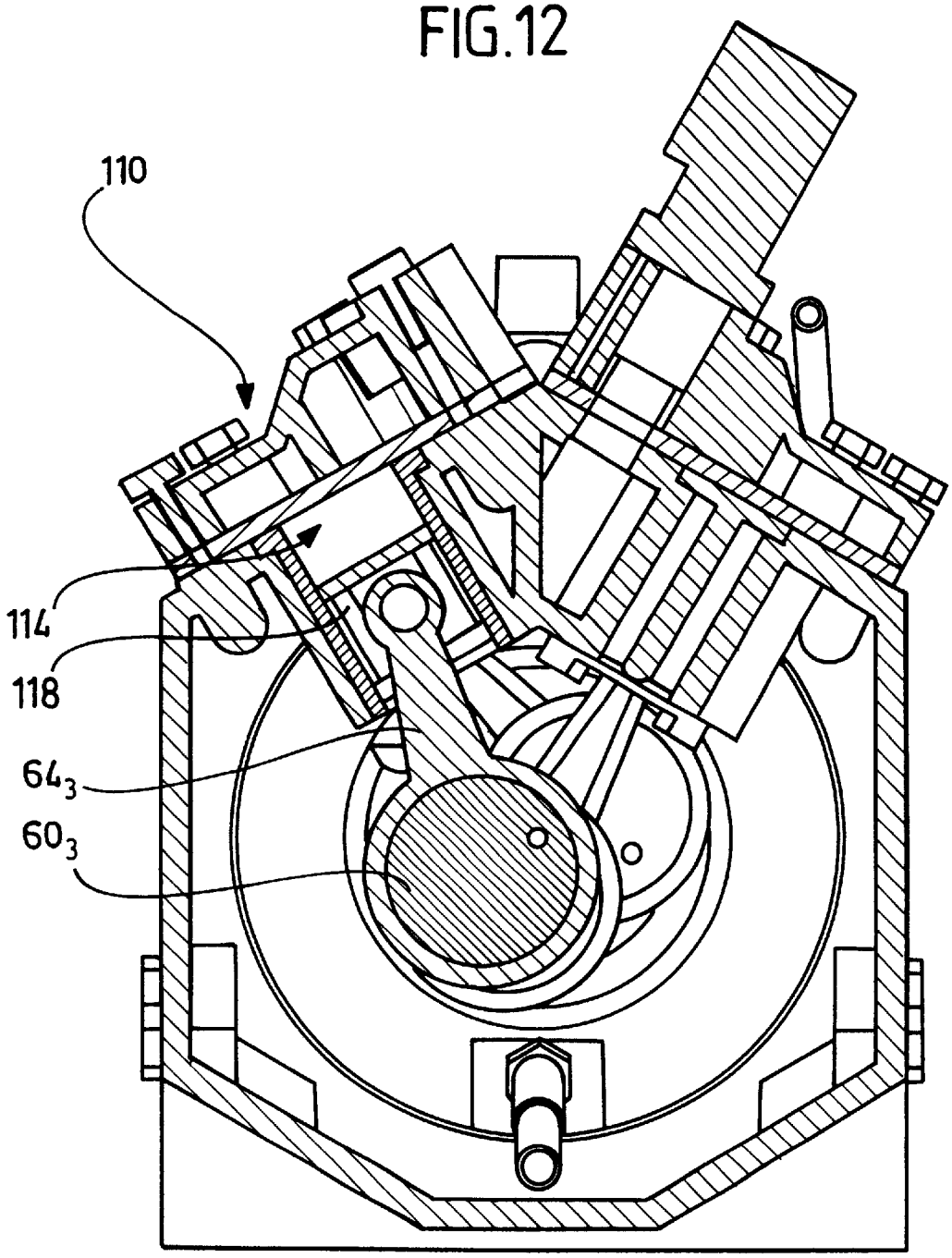
Figure 13:
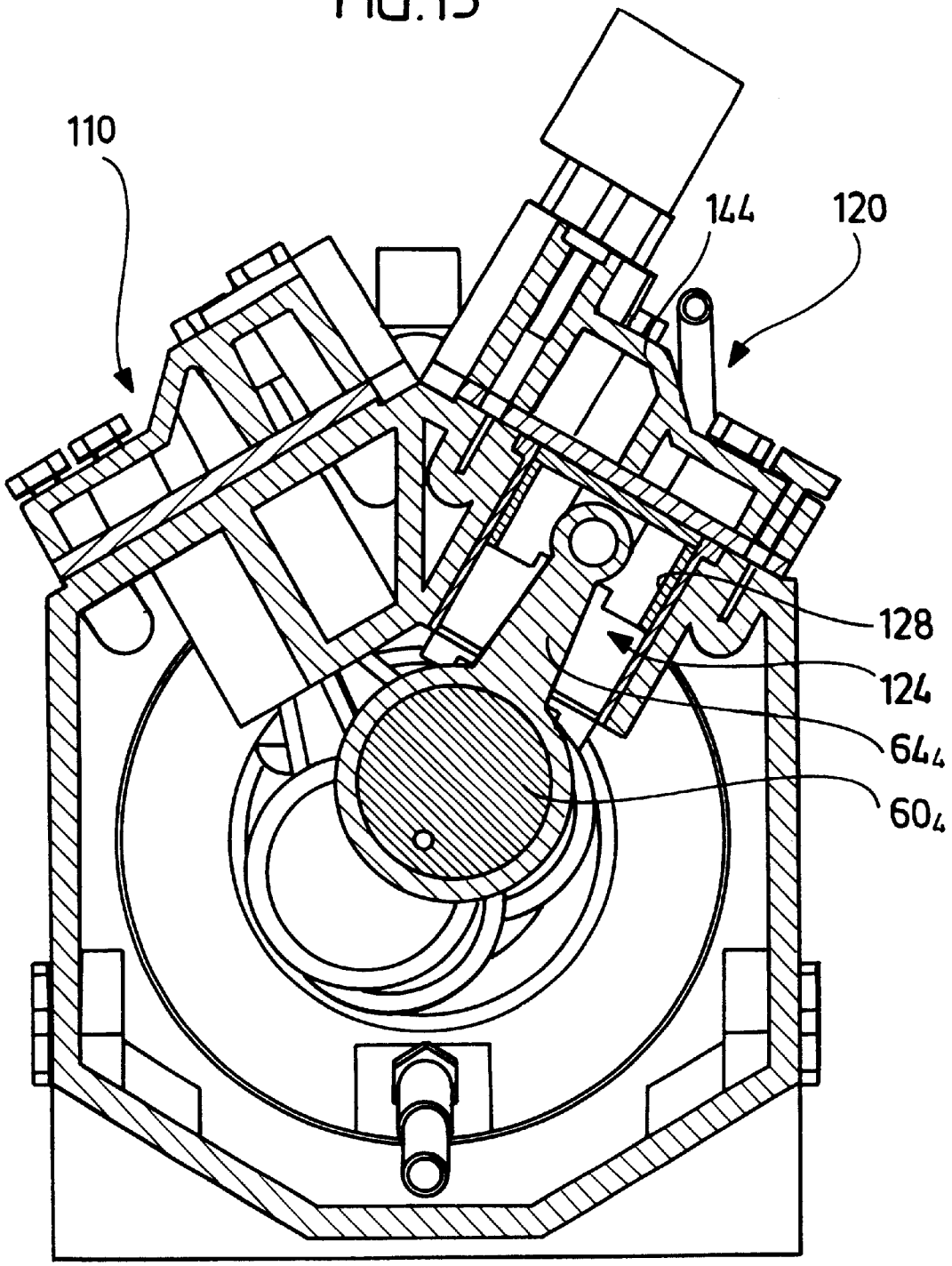
Figure 14:
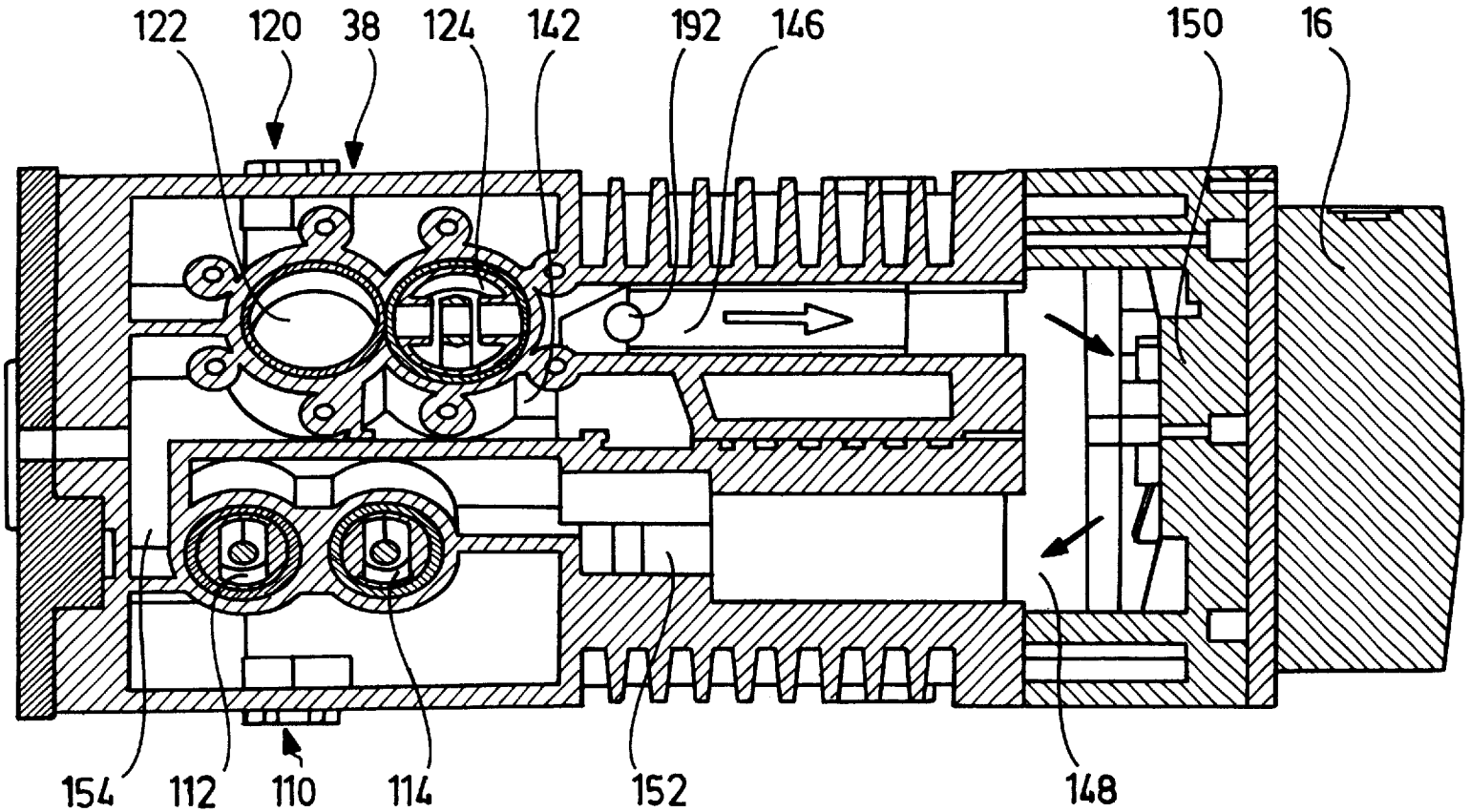
Figure 15:
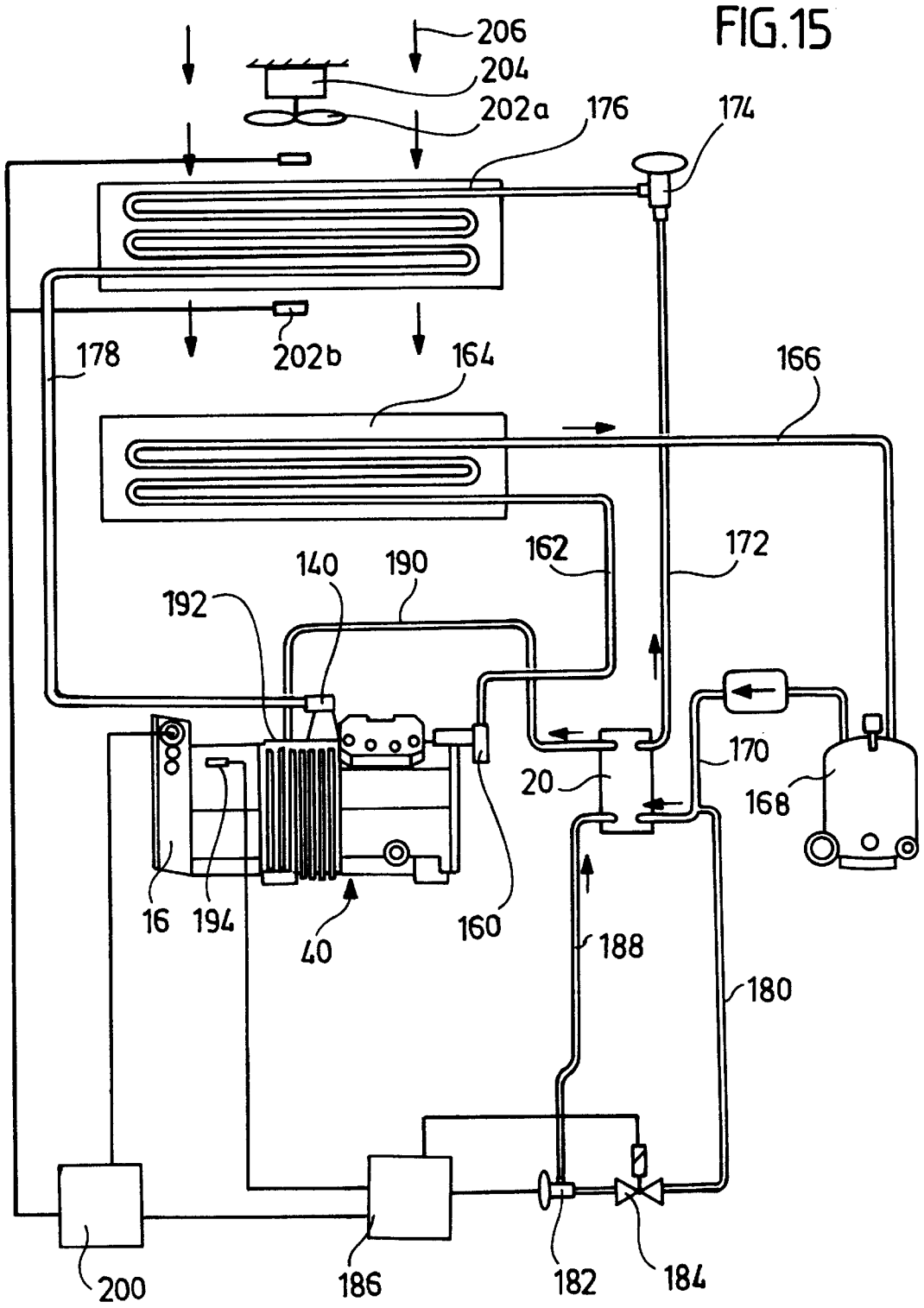
Figure 16:
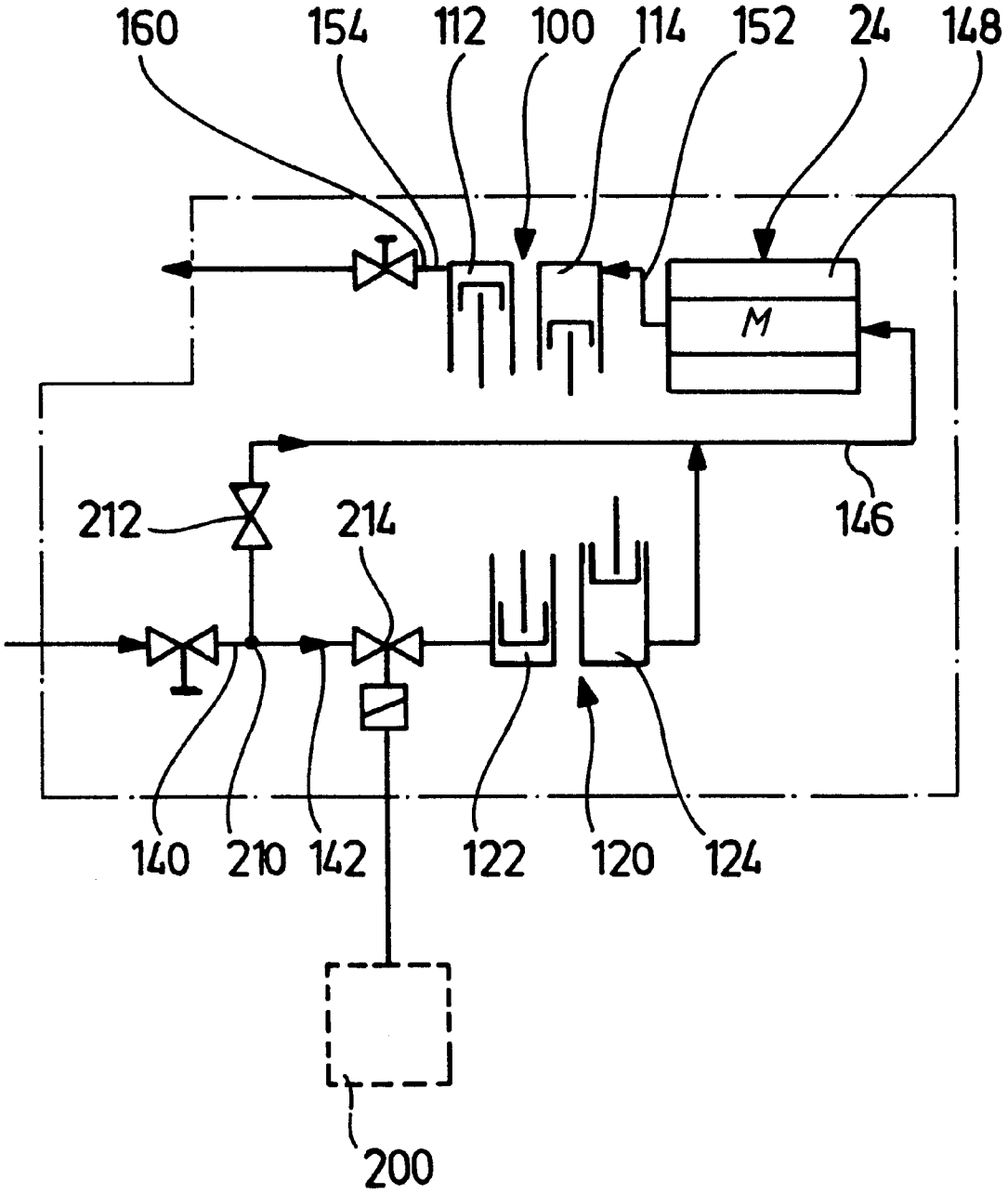

In the drawings:

| | |
|---|---|
| Figure 1 | shows a perspective view of an inventive refrigerant compressor apparatus; |
| Figure 2 | shows a longitudinal section through the inventive refrigerant compressor apparatus; |
| Figure 3 | shows a plan view of a compressor shaft in the direction of arrow A in Figure 4; |
| Figure 4 | shows a partially broken open side view of the compressor shaft of the inventive refrigerant compressor apparatus; |
| Figure 5 | shows a section along line 5-5 in Figure 4; |
| Figure 6 | shows a section along line 6-6 in Figure 4; |
| Figure 7 | shows a section along line 7-7 in Figure 4; |
| Figure 8 | shows a section along line 8-8 in Figure 4; |
| Figure 9 | shows a section along line 9-9 in Figure 4; |
| Figure 10 | shows a section along line 10-10 in Figure 2; |
| Figure 11 | shows a section along line 11-11 in Figure 2; |
| Figure 12 | shows a section along line 12-12 in Figure 2; |
| Figure 13 | shows a section along line 13-13 in Figure 13 |
| Figure 14 | shows a section through the entire refrigerant compressor apparatus along line 14-14 in Figure 10; |
| Figure 15 | shows a schematic illustration of incorporation of the inventive refrigerant compressor apparatus in a refrigeration plant; |
| Figure 16 | shows an operating diagram of a switching off of a low pressure stage in the inventive refrigerant compressor apparatus. |

One embodiment of an inventive refrigerant compressor apparatus, illustrated in FIG. 1, comprises an apparatus housing which is designated as a whole as 10, extends in a longitudinal direction 12 and bears a converter 16 at a first end face 14 extending transversely to the longitudinal direction 12 while a liquid supercooler designated as a whole as 20 is arranged at an end face 18 located opposite the end face 14.

As illustrated in FIG. 2, a drive motor designated as a whole as 24 is arranged in the apparatus housing 10 in a motor housing section 22, this drive motor having a stator 26 arranged in the motor housing section 22 and a rotor 28 which is surrounded by the stator 26 and is rotatable about an axis of rotation 30. In this respect, the rotor 28 is seated on a shaft section 32 of a compressor shaft designated as a whole as 34.

Furthermore, the apparatus housing 10 comprises a compressor housing section 38 of a compressor for the refrigerant designated as a whole as 40.

The compressor housing section 38 extends from the end face 18 of the apparatus housing 10 as far as a dividing wall 42 which separates the compressor housing section 38 from the motor housing section 22.

A compressor shaft bearing designated as a whole as 44 is arranged in the dividing wall 42 and mounts the shaft 34 in a first bearing section 46 which is arranged on a side of the shaft section 32 bearing the rotor 28 which faces the compressor 40.

Furthermore, a second compressor shaft bearing 50 is arranged close to the end face 18 in a bearing bracket 48 of the apparatus housing 10 and the shaft 34 is rotatably mounted in this second bearing with a second bearing section 52.

As a result, the compressor shaft 34 supports the rotor 28 on its shaft section 32 freely projecting beyond the first bearing section 46 on a side located opposite the second bearing section 52 and so the compressor shaft 34 is mounted in a simple manner with only two bearings sections 46, 52.

An eccentric section of the compressor shaft 34 designated as a whole as 54 is located between the first bearing section 46 and the second bearing section 52, this eccentric section extending through the compressor housing section 38 and bearing four eccentrics $\mathbf{60}_1$, $\mathbf{60}_2$, $\mathbf{60}_3$ and $\mathbf{60}_4$ which are arranged, proceeding from the second bearing section 52, so as to follow one another in the direction of the first bearing section 46 along the axis of rotation 30 and are spaced from one another.

The eccentrics $\mathbf{60}_1$ to $\mathbf{60}_4$ are designed as approximately disk-shaped members which have a circular-cylindrical casing surface $\mathbf{62}_1$ to $\mathbf{62}_4$ are arranged eccentrically to the axis of rotation 30 of the compressor shaft and each form the running surface for piston rods $\mathbf{64}_1$ to $\mathbf{64}_4$ surrounding them.

The cylinder casing surfaces $\mathbf{62}_1$to $\mathbf{62}_4$ of the eccentrics $\mathbf{60}_1$ to $\mathbf{60}_4$ are preferably arranged such that a central axis $\mathbf{66}_1$ of the cylinder casing surface $\mathbf{62}_1$ is located in a plane $\mathbf{68}_1$ which extends through the central axis $\mathbf{66}_1$ and the axis of rotation 30.

A plane $\mathbf{68}_2$, in which a central axis $\mathbf{66}_2$ of the cylinder casing surface $\mathbf{62}_2$ is located and which extends, in addition, through the axis of rotation 30, is turned through an angle of 150° in relation to the plane $\mathbf{68}_1$.

Furthermore, the central axis $\mathbf{66}_3$ of the cylinder casing surface $\mathbf{62}_3$ of the eccentric $\mathbf{60}_3$ is located in a plane $\mathbf{68}_3$ which is turned through 180° in relation to the plane $\mathbf{68}_1$, i.e. the central axes $\mathbf{66}_1$ and $\mathbf{68}_3$ of the eccentrics $\mathbf{60}_1$ and $\mathbf{60}_3$ are arranged on sides of the axis of rotation 30 located exactly opposite one another.

Furthermore, a central axis $\mathbf{66}_4$ of the cylinder casing surface $\mathbf{62}_4$ of the eccentric $\mathbf{60}_4$ is located in a plane $\mathbf{68}_4$ which is turned through 330° in relation to the plane $\mathbf{68}_1$, i.e. is turned through 180° in relation to the plane $\mathbf{68}_2$ and through 150° in relation to the plane $\mathbf{68}_3$.

The central axes $\mathbf{66}_4$ and $\mathbf{66}_2$ are thus located exactly opposite one another with respect to the axis of rotation 30.

The eccentrics $\mathbf{60}_1$ and $\mathbf{60}_2$ as well as the eccentrics $\mathbf{60}_3$ and $\mathbf{60}_4$ thus form a respective pair, in which the two eccentrics are arranged relative to one another so as to be turned through an angle of 150° in relation to the axis of rotation 30 and, in addition, the respectively first eccentrics $\mathbf{60}_1$ and $\mathbf{60}_3$ of the two pairs and the respectively second eccentrics $\mathbf{60}_2$ and $\mathbf{60}_4$ of the two pairs are arranged to as to be located opposite one another in relation to the axis of rotation 30.

The compressor shaft 34 comprises, in addition, as illustrated in FIG. 2 and FIG. 4, a lubricant channel 70 which passes through it, extends from an entry opening 72 facing the end face 18 coaxially to the axis of rotation 30 through the entire compressor shaft 34 and is closed in the area of the first bearing section 46. Furthermore, a transverse channel 74 branches off this lubricant channel in the area of the first bearing section 52 and exits in the area of the first bearing section 52 in order to lubricate this. Moreover, transverse channels $\mathbf{76}_1$ to $\mathbf{76}_4$ are provided in the area of the respective eccentrics $\mathbf{60}_1$ to $\mathbf{60}_4$ and these each open into the corresponding casing surface $\mathbf{62}_1$ to $\mathbf{62}_4$ in an area $\mathbf{78}_1$ to $\mathbf{78}_4$ located closest to the axis of rotation and allow lubricating oil to exit.

Finally, two transverse channels 80 and 82 are provided in the area of the first bearing section 46 and these contribute to the lubrication thereof.

In order to be able to mount the individual piston rods $\mathbf{64}_1$ to $\mathbf{64}_4$ on the individual eccentrics $\mathbf{60}_1$ to $\mathbf{60}_4$, an intermediate area 90 is provided between the bearing section 52 and the eccentric $\mathbf{60}_1$ and this, as illustrated in FIG. 5, has a cross section, the first outer contour area $\mathbf{92}_1$ of which extends in a radial direction in relation to the axis of rotation 30 at the most as far as the cylinder casing surface 96 of the second bearing section 52 while a second outer contour area $\mathbf{94}_1$ of the cross section extends in a radial direction in relation to the axis of rotation 30 at the most as far as the cylinder casing surface $\mathbf{62}_1$ of the first eccentric $\mathbf{60}_1$.

Furthermore, an intermediate element 98 is located between the first eccentric $\mathbf{60}_1$ and the second eccentric $\mathbf{60}_2$ (FIGS. 4 and 6) and this extends in the direction of the axis of rotation 30 over a length which corresponds at least to a width of the piston rods 64 in this direction. Furthermore, the intermediate element 98 has a cross section, the first outer contour area $\mathbf{92}_2$ of which extends in a radial direction in relation to the axis of rotation 30 at the most as far as the cylinder casing surface $\mathbf{62}_1$ of the first eccentric $\mathbf{60}_1$ and the second outer contour area $\mathbf{94}_2$ of which extends in a radial direction in relation to the axis of rotation 30 at the most as far as the cylinder casing surface $\mathbf{62}_2$ of the second eccentric $\mathbf{60}_2$.

As a result, a piston rod pushed with its lug over the first eccentric $\mathbf{60}_1$ can be displaced further in the direction of the second eccentric $\mathbf{60}_2$ to such an extent that the lug surrounds the intermediate element 98 and can then be displaced transversely to the axis of rotation 30 to such an extent that the lug can be displaced over the second eccentric $\mathbf{60}_2$ as a result of further displacement in the direction of the axis of rotation 30.

In the same way, an intermediate element 100 is provided between the second eccentric $\mathbf{60}_2$ and the third eccentric $\mathbf{60}_3$ (FIGS. 4 and 7), the first outer contour area 923 of which extends in a radial direction in relation to the axis of rotation 30 at the most as far as the cylinder casing surface $\mathbf{62}_2$ of the second eccentric $\mathbf{60}_2$ and the second outer contour area $\mathbf{94}_3$ of which extends in a radial direction in relation to the axis of rotation 30 at the most as far as the cylinder casing surface $\mathbf{62}_3$ of the third eccentric. Furthermore, the intermediate element 100 has a third outer contour area $\mathbf{95}_3$ which has, for example, a radial extension in relation to the axis of rotation 30 as far as the casing surface 96.

A further intermediate element 102 is provided between the third eccentric $\mathbf{60}_3$ and the fourth eccentric $\mathbf{60}_4$ (FIGS. 4 and 8) and this has a first outer contour area $\mathbf{92}_4$ which reaches in a radial direction in relation to the axis of rotation 30 at the most as far as the cylinder casing surface $\mathbf{62}_3$ of the third eccentric $\mathbf{60}_3$ and a second outer contour area $\mathbf{94}_4$ which reaches in a radial direction in relation to the axis of rotation 30 at the most as far as the cylinder surface $\mathbf{62}_4$ of the fourth eccentric $\mathbf{60}_4$.

In this respect, all the intermediate elements 98, 100, 102 preferably extend in the direction of the axis of rotation 30 over a length which corresponds to a width of the piston rods 64, when seen in the direction of the axis of rotation 30, so that assembly of the piston rods 64 with their lugs 50 on the eccentrics 60 can take place as described above in conjunction with the first and second eccentrics $\mathbf{60}_1$, $\mathbf{60}_2$.

Furthermore, as illustrated in FIG. 9, an intermediate area 104 is provided between the fourth eccentric $\mathbf{60}_4$ and the first bearing section 46 and this extends in a radial direction in relation to the axis of rotation 30 in a first outer contour area $\mathbf{92}_5$ at the most as far as the cylinder casing surface $\mathbf{60}_4$ and with a second outer contour area $\mathbf{94}_5$ at the most as far as a cylinder casing surface 106 of the first bearing section 46.

As illustrated in FIGS. 10 to 13, two rows of cylinders can be driven with the eccentrics 60 of the compressor shaft 34, namely with the eccentrics $\mathbf{60}_1$ and $\mathbf{60}_3$ a first row 110 of cylinders 112 and 114, in which pistons 116 and 118 movable by the piston rods $\mathbf{64}_1$ and $\mathbf{64}_3$ are arranged, and with the eccentrics $\mathbf{60}_2$ and $\mathbf{60}_4$ a second row 120 of cylinders 122 and 124, in which pistons 126 and 128 movable by the piston rods $64_2$ and $64_4$ are arranged.

In this respect, the first row 110 with the cylinders 112 and 114 forms a high pressure stage of the compressor 40 designed in several stages and the second row 120 with the cylinders 122 and 124 a low pressure stage of the compressor 40 designed in several stages.

The cylinders 112 and 114 of the high pressure stage preferably have a smaller cross section than the cylinders 122 and 124 of the low pressure stage while the stroke is the same on account of the use of eccentrics $60_1$ to $60_4$ of an identical design in all the cylinders 112 and 114 as well as 122 and 124.

As illustrated in FIGS. 10 to 13, the first row 110 of the cylinders 112 and 114 is arranged symmetrically to a plane 130 extending through the axis of rotation 30 while the second row 120 with the cylinders 122 and 124 is located symmetrically to a plane 132 extending through the axis of rotation 30 and both planes 130 and 132 form with one another a V angle $\alpha$ of 60°.

Furthermore, it is illustrated in FIGS. 10 and 12 that the eccentrics $60_1$ and $60_3$ are arranged such that the pistons 116 and 118 move relative to one another with an offset angle of exactly 180 and, in addition, the eccentrics $60_2$ and $60_4$ are arranged such that the pistons 126 and 128 likewise move relative to one another so as to be offset through an angle of 180°, wherein in FIG. 11 the piston 126 is in the lower dead center and in FIG. 13 the piston 128 in the upper dead center while, on the other hand, the two pistons 116 and 118 are located exactly between the upper dead center and the lower dead center. This means that the pistons 116 and 118 of the row 110 move exactly offset through an angle of 90° in relation to the pistons 126 and 128 of the row 120.

Such an arrangement of the pistons 116, 118, 126, 128 and the eccentrics 60 an of the compressor shaft 34 permits a running of the compressor 40 extremely low in vibration.

As illustrated in FIG. 14, the apparatus housing 10 is designed such that a low pressure connection 140 is arranged on it as refrigerant inlet, refrigerant flowing through this connection into a low pressure channel 142 which is provided in the apparatus housing and leads to the two cylinders 122 and 124 of the row 120 forming the low pressure stage, wherein the refrigerant which is at a low pressure can enter the cylinders 122 and 124 via a common cylinder head cover 144 illustrated in FIGS. 11 and 13.

Furthermore, refrigerant compressed to a medium pressure exits from the cylinders 122 and 124 into a medium pressure channel 146 which merges from the cylinder head cover 144 into the apparatus housing 10, namely in the area close to the dividing wall 42, wherein the refrigerant compressed to a medium pressure then flows from the medium pressure channel 146 into an interior 148 of the drive motor 24 and there flows against an end wall 150 forming the end face 14 and attemperates it. The end wall 150 is in thermal contact with the converter 16 and thus serves to cool the converter 16, in particular, electrical power parts thereof. The refrigerant at a medium pressure flows from the end wall 150 further into a flow-in channel 152 which leads to the cylinders 112 and 114 of the row 110 forming the high pressure stage. In it, the refrigerant is compressed to high pressure and this then enters a high pressure channel 154 of the apparatus housing 10 and flows through this to a high pressure connection 160.

The inventive refrigerant compressor apparatus is preferably used in a refrigeration plant constructed in a known manner, as illustrated in FIG. 15. In this respect, a line 162 leads from the high pressure connection 160 to a condenser designated as a whole as 164. From there, liquid refrigerant flows in a line 176 to a collector 168 for the liquid refrigerant. From the collector 168 liquid refrigerant flows via a line 170 to the liquid cooler 120, wherein the majority of the liquid refrigerant flows through the liquid supercooler 20 and flows via a line 172 to an expansion valve 174 for a vaporizer 176. After flowing through the vaporizer 176, the vaporized refrigerant flows via a line 178 to the low pressure connection 140 of the inventive refrigerant compressor apparatus.

A small portion of the liquid refrigerant is branched off from the line 170 prior to the liquid supercooler 20 and guided via a line 180 to an injection valve 182, wherein a solenoid valve 184 controllable by a control 196 is arranged in front of the injection valve 182.

The injection valve 182 represents an expansion valve for the liquid cooler 120 which supplies liquid refrigerant to the liquid supercooler 20 via a line 188, the liquid refrigerant vaporizing in this supercooler and supercooling the flow of liquid refrigerant from the line 170 into the line 172 so that supercooled liquid refrigerant flows in the line 172 to the expansion valve 174. The vaporized refrigerant from the liquid supercooler 20 is guided via a line 190 to a medium pressure connection 192 illustrated in FIGS. 14 and 15, via which it enters the medium pressure channel 146 and together with the refrigerant coming from the low pressure stage 120 and compressed to medium pressure flows through the interior 148 of the drive motor 24 and then enters the high pressure stage 110.

Via a temperature sensor 194 arranged on the motor housing section 22 of the apparatus housing 10 the control 186 detects, in addition, its temperature and controls the solenoid valve 184 such that the motor housing section 22, in particular, the end wall 150 is kept, for example, at a temperature in the range of approximately 30° to approximately 50° centigrade and thus moisture is prevented from condensing in the area of the converter 16. This temperature range is, in addition, selected such that the respective refrigerant has a suitable overheating prior to entering the high pressure stage 110.

In addition, a control 200 is provided which controls the drive motor 24 with respect to its speed via the converter 16 and controls the power of the drive motor 24 in accordance with a temperature at the vaporizer 176 measured by a temperature sensor such that the desired cooling capacity is available at the vaporizer 176. The temperature is preferably measured at the vaporizer 176 by means of temperature sensors 202*a* and 202*b* which are arranged in a flow of air 206 passing through the vaporizer 176 and circulated by means of a blower 204 in order to detect the temperature of the flow of air 206 in front of the vaporizer 176—temperature sensor 202*a*—and behind the vaporizer 176—temperature sensor 202*b*.

A particularly advantageous design of the control 200 provides for this to serve to regulate the temperature of the flow of air 206, which is automatically circulated, for example, in a space to be cooled by means of the blower 204, very precisely to a predetermined temperature, for example, with a regulation accuracy of 0.5°.

In this case, it is provided for the control 200 to operate the inventive refrigerant compressor apparatus in the range of regulation above a minimum cooling capacity free from interruptions, i.e. not as in the state of the art to switch off the refrigerant compressor apparatus following a sufficiently vigorous cooling and to wait until the temperature rises again in order to switch the apparatus on again but rather to increase or reduce the cooling capacity in accordance with the temperature of the flow of air 206 by altering the speed of the drive motor. As a result, the possibility is created of regulating the temperature of the flow of air 206 exactly within a range of regulation of 20:1 merely by varying the speed, wherein the desired temperature, to which it is to be regulated, is freely selectable.

Only in the case of a minimum cooling capacity which is, for example, less than 5% of the maximum cooling capacity of the refrigerant compressor apparatus will a temporary switching off of the refrigerant compressor apparatus be brought about by the control 200 since, in such a case, the external input of heat into the flow of air 206 is so slight that the heating up thereof is brought about with a very large inertia and so the specified regulation accuracy can be maintained even with a temporary switching off of the refrigerant compressor apparatus.

The control 200 is preferably coupled to the control 186 in addition.

In order to be able to operate the inventive refrigerant compressor apparatus with as little drive energy as possible, the possibility is provided, in addition and as illustrated in FIG. 16, of switching off the low pressure stage 120 with the cylinders 122 and 124 with respect to their compression effect. For this purpose, a branch line 210 is provided in the low pressure channel 142 following the low pressure connection 140, wherein a check valve 212 is connected to the branch line 210 and this is in a position to connect the low pressure channel 142 with the medium pressure channel 146 when the pressure in the medium pressure channel 146 is below the pressure in the low pressure channel 142. Furthermore, a capacity regulation valve 214 is provided in the low pressure channel 142 and this is in a position to throttle or block the flow of gaseous refrigerant via the low pressure channel 142 into the low pressure stage 120. As a result, it is possible to reduce the compression capacity of the low pressure stage 120 to such an extent that the pressure in the medium pressure channel 146 drops to such an extent that refrigerant flows via the branch line 210 out of the low pressure channel 142 via the check valve 112 into the medium pressure channel 146, flows through the interior 148 of the drive motor 24 and then enters the high pressure stage 110 with the cylinders 112 and 114 in order to be compressed in this to a high pressure, wherein the refrigerant subject to high pressure flows via the high pressure channel 154 to the high pressure connection 160.

If, as a result, only a low cooling capacity is required at the vaporizer 202, the control 200 can reduce the power requirements of the drive motor 24 by switching off the low pressure stage 120 due to the fact that only the high pressure stage 110 is still operating and compresses the refrigerant to a lower pressure which is sufficient for the cooling capacity required in this case. As a result, the drive motor 24 is loaded to a lesser degree at the same time and thus takes up less power, as well.

If, on the other hand, a high cooling capacity is again required at the vaporizer 202, this is detected by the control 200 by means of the temperature sensor 202 and the control is again in a position to increase the cooling capacity by switching in the low pressure stage 120.

In all the cases, it is, however, ensured with this solution that the refrigerant always flows through the interior 148 and thus cools the end wall 150 and with it also the converter 16 to an adequate degree.

The switching off of the low pressure stage 120 by the control 186 in communication with the control 200 makes a particularly advantageous, exact regulation of the temperature of the flow of air 206 possible since, in the case of a reduction in the cooling capacity, the speed of the drive motor 24 is reduced first of all by the control 200 with the low pressure stage 120 in operation. The switching off of the low pressure stage 120 has the advantage that the speed of the drive motor 24 does not have to be run by the control 200 at an optionally low level but rather that after the low pressure stage 120 has been switched off the drive motor 24 can again be operated at a higher speed in order to compensate for the drop in the compression capacity occurring due to the switching off of the low pressure stage 120. During a further reduction, the speed of the drive motor 24 can again be lowered from the higher level.

On the other hand, with a cooling capacity increasing from the lowest level the refrigerant compressor apparatus is, first of all, operated only with the high pressure stage 110 and the low pressure stage 120 switched off with increasing speed of the drive motor 24. When the cooling capacity increases further beyond a switch-on level of the low pressure stage 120, the low pressure stage 120 is switched in and, on the other hand, the speed of the drive motor is reduced to a low level since both stages 110 and 120 of the refrigerant compressor apparatus are now operating and from this point an increase in the cooling capacity is again possible with a further increase in the speed.

What is claimed is:

1. Refrigerant compressor apparatus comprising:

a drive motor, a compressor driven by the drive motor and having at least four cylinders arranged in a V shape, a compressor shaft bearing eccentrics for driving pistons operating in respective ones of said cylinders, the cylinders being arranged at a V angle of less than 360° divided by the number of cylinders, the compressor shaft being mounted with only two bearing sections thereof in corresponding compressor shaft bearings, the eccentrics being arranged between the bearing sections, each eccentric being surrounded by a lug of an undivided piston rod, and a separate eccentric being provided for each piston rod and arranged at a distance from the other, separate eccentrics for the respectively other piston rods with their piston, and at least two consecutive separate eccentrics being separated from one another by intermediate elements having, in a direction of an axis of rotation, a length corresponding at least to a width of one of said piston rods.

2. Refrigerant compressor apparatus as defined in claim 1, wherein the separate eccentrics are separated from one another by intermediate elements having, in a direction of an axis of rotation, a length corresponding at least to a width of a piston rod.

3. Refrigerant compressor apparatus comprising:

a drive motor, a compressor driven by the drive motor and having several cylinders arranged in a V shape, a compressor shaft bearing eccentrics for driving pistons operating in respective ones of said cylinders, the cylinders being arranged at a V angle of less than 360° divided by the number of cylinders, the compressor shaft being mounted with only two bearing sections thereof in corresponding compressor shaft bearings, the eccentrics being arranged between the bearing sections, a separate eccentric being provided for each piston and arranged at a distance from the other, separate eccentrics for the respectively other pistons, the separate eccentrics being separated from one another by intermediate elements having, in a direction of an axis of rotation, a length corresponding at least to a width of a piston rod, the intermediate elements having a cross-sectional shape extending, in a radial direction in relation to the axis of rotation, at the most as far as the closest one of two casing surfaces, one of said two casing surfaces being the casing surface of one of two consecutive eccentrics, and the other of said two casing surfaces being the casing surface of the other of the two consecutive eccentrics.

4. Refrigerant compressor apparatus as defined in claim 1, wherein the compressor shaft has a lubricant channel coaxial to the axis of rotation.

5. Refrigerant compressor apparatus as defined in claim 1, wherein the compressor has four cylinders arranged in a V shape which form with one another a V angle of less than 70°.

6. Refrigerant compressor apparatus as defined in claim 5, wherein the compressor has four cylinders arranged in a V shape which form with one another a V angle of approximately 60°.

7. Refrigerant compressor apparatus comprising:

a drive motor, a compressor driven by the drive motor and having several cylinders arranged in a V shape, a compressor shaft bearing eccentrics for driving pistons operating in respective ones of said cylinders, the cylinders being arranged at a V angle of less than 360° divided by the number of cylinders, the compressor shaft being mounted with only two bearing sections thereof in corresponding compressor shaft bearings, the eccentrics being arranged between the bearing sections, a separate eccentric being provided for each piston and arranged at a distance from the other, separate eccentrics for the respectively other pistons, each of the eccentrics being arranged in relation to the other eccentrics so as to be turned through an angle with respect to an axis of rotation of the compressor shaft.

8. Refrigerant compressor apparatus comprising:

a drive motor, a compressor driven by the drive motor and having several cylinders arranged in a V shape, a compressor shaft bearing eccentrics for driving pistons operating in respective ones of said cylinders, the cylinders being arranged at a V angle of less than 360° divided by the number of cylinders, the compressor shaft being mounted with only two bearing sections thereof in corresponding compressor shaft bearings, the eccentrics being arranged between the bearing sections, a separate eccentric being provided for each piston and arranged at a distance from the other, separate eccentrics for the respectively other pistons, the eccentrics forming pairs arranged so as to follow one another in a direction of an axis of rotation of the compressor shaft, and the eccentrics forming a respective pair being arranged so as to be turned in relation to one another through an angle of 360° divided by the number of cylinders plus the V angle.

9. Refrigerant compressor apparatus as defined in claim 8, wherein the first eccentrics of each of the pairs and the second eccentrics of each of the pairs are arranged so as to be respectively turned through 180° in relation to one another.

10. Refrigerant compressor apparatus as defined in claim 1, wherein:

the compressor comprises at least four cylinders, and the compressor shaft comprises at least four separate eccentrics arranged at a distance from one another.

11. Refrigerant compressor apparatus comprising:

a drive motor, a compressor driven by the drive motor and having several cylinders arranged in a V shape, a compressor shaft bearing eccentrics for driving pistons operating in respective ones of said cylinders, the cylinders being arranged at a V angle of less than 360° divided by the number of cylinders, the compressor having:

a low pressure stage comprising at least one cylinder, and a high pressure stage comprising at least one cylinder, the sum of the cylinder volumes of the at least one cylinder of the low pressure stage being greater than the sum of the cylinder volumes of the at least one cylinder of the high pressure stage.

12. Refrigerant compressor apparatus as defined in claim 11, wherein:

one row of the cylinders arranged in a V shape forms the low pressure stage, and the other row of cylinders forms the high pressure stage.

13. Refrigerant compressor apparatus as defined in claim 11, wherein the low pressure stage is reducible in capacity.

14. Refrigerant compressor apparatus comprising:

a drive motor, a compressor driven by the drive motor and having several cylinders arranged in a V shape, a compressor shaft bearing eccentrics for driving pistons operating in respective ones of said cylinders, the cylinders being arranged at a V angle of less than 360° divided by the number of cylinders, the compressor having:

a low pressure stage comprising at least one cylinder, and a high pressure stage comprising at least one cylinder, a capacity regulation valve being arranged on the suction side of the low:pressure stage, and a check valve being arranged between a low pressure connection of the compressor and a suction side of the high pressure stage, said check valve opening automatically when the capacity regulation valve is active as a function of the resulting difference in pressure.

15. Refrigerant compressor comprising:

a drive motor, a compressor driven by the drive motor and having several cylinders arranged in a V shape, a compressor shaft bearing eccentrics for driving pistons operating in respective ones of said cylinders, the cylinders being arranged at a V angle of less than 360° divided by the number of cylinders, the compressor having:

a low pressure stage comprising at least one cylinder, and a high pressure stage comprising at least one cylinder, refrigerant flowing from the low pressure stage to the high pressure stage also flows through said drive motor.

16. Refrigerant compressor apparatus as defined in claim 15, wherein the drive motor of the compressor has the refrigerant entering the high pressure stage flowing through it.

17. Refrigerant compressor apparatus comprising:

a drive motor, a compressor driven by the drive motor and having several cylinders arranged in a V shape, a compressor shaft bearing eccentrics for driving pistons operating in respective ones of said cylinders, the cylinders being arranged at a V angle of less than 360° divided by the number of cylinders, said drive motor being provided with a converter for speed control, said converter being arranged on the drive motor, with electrical power components of said converter being thermally coupled to a housing of the drive motor.

18. Refrigerant compressor apparatus as defined in claim 17, wherein a housing part thermally coupled to the power components of the converter is in thermal contact with refrigerant.

19. Refrigerant compressor apparatus as defined in claim 17, wherein the converter is arranged on a side of the housing of the drive motor located opposite the compressor.

20. Refrigerant compressor apparatus as defined in claim 1, wherein the drive motor is speed controlled.

21. Refrigerant compressor apparatus as defined in claim 20, wherein a control is provided for controlling the speed of the drive motor in accordance with a required cooling capacity.

22. Refrigerant compressor apparatus as defined in claim 21, wherein the control regulates a temperature of a medium to be cooled.

23. Refrigerant compressor apparatus as defined in claim 22, wherein the control regulates the temperature of the medium to be cooled in a range above a minimum cooling capacity due to speed-controlled operation of the drive motor free from running interruptions.

24. Refrigerant compressor apparatus as defined in claim 1, wherein a control controls the speed of the drive motor in accordance with ambient temperature.

25. Refrigerant compressor apparatus as defined in claim 11, wherein a control is provided for switching off the low pressure stage when the cooling capacity falls below a predeterminable capacity.

26. Refrigerant compressor apparatus comprising:

a drive motor, a compressor driven by the drive motor and having several cylinders arranged in a V shape, a compressor shaft bearing eccentrics for driving pistons operating in respective ones of said cylinders, the cylinders being arranged at a V angle of less than 360° divided by the number of cylinders, a liquid subcooler being arranged on a side of the compressor located opposite the drive motor.

27. Refrigerant compressor apparatus comprising:

a drive motor, a compressor driven by the drive motor and having several cylinders arranged in a V shape, a compressor shaft bearing eccentrics for driving pistons operating in respective ones of said cylinders, the cylinders being arranged at a V angle of less than 360° divided by the number of cylinders, a liquid subcooler, said liquid subcooler vaporizing liquid refrigerant, and the vaporized refrigerant entering refrigerant flowing to a high pressure stage of the compressor.

28. Refrigerant compressor apparatus as defined in claim 27, wherein the vaporized refrigerant flows through the drive motor on its way to the high pressure stage.

29. Refrigerant compressor apparatus as defined in claim 28, wherein the liquid subcooler is controllable in accordance with a temperature of the drive motor.

30. Refrigerant compressor apparatus as defined in claim 28, wherein:

a converter is arranged on a housing of the drive motor, and the liquid subcooler is controllable in accordance with the temperature of the part of the drive motor housing bearing the converter.

31. Refrigerant compressor apparatus as defined in claim 30, wherein the liquid subcooler is controlled such that it maintains a minimum temperature of the part of the drive motor housing bearing the converter.

* * * * *